US008536550B2

(12) United States Patent
Asayama et al.

(10) Patent No.: US 8,536,550 B2
(45) Date of Patent: Sep. 17, 2013

(54) METHOD AND APPARATUS FOR CLEANING COLLECTOR MIRROR IN EUV LIGHT GENERATOR

(75) Inventors: Takeshi Asayama, Hiratsuka (JP); Hiroshi Someya, Hiratsuka (JP); Masato Moriya, Hiratsuka (JP); Hideo Hoshino, Hiratsuka (JP); Tamotsu Abe, Hiratsuka (JP)

(73) Assignee: Gigaphoton Inc., Oyama-shi (JP)

( * ) Notice: Subject to any disclaimer, the term of this patent is extended or adjusted under 35 U.S.C. 154(b) by 1008 days.

(21) Appl. No.: 12/478,083

(22) Filed: Jun. 4, 2009

(65) Prior Publication Data

US 2009/0301517 A1 Dec. 10, 2009

(30) Foreign Application Priority Data

Jun. 5, 2008 (JP) ..... 2008-148088

(51) Int. Cl.
*B08B 7/00* (2006.01)

(52) U.S. Cl.
USPC ..... 250/504 R; 250/493.1; 250/503.1; 156/345.24; 156/345.31; 156/345.35; 156/345.37; 156/345.5; 118/715; 118/719; 134/1.1; 134/1

(58) Field of Classification Search
USPC ..... 156/345.24, 345.2, 345.22, 345.23, 156/345.31, 345.32, 345.35, 345.37, 345.43, 156/345.46; 250/493.1, 503.1, 504 R; 118/715, 118/723 R, 719; 134/1.1, 1
See application file for complete search history.

(56) References Cited

U.S. PATENT DOCUMENTS

| | | | | |
|---|---|---|---|---|
| 5,981,399 | A * | 11/1999 | Kawamura et al. | 438/715 |
| 6,391,114 | B1 * | 5/2002 | Kirimura | 118/719 |
| 6,537,461 | B1 * | 3/2003 | Nakahara et al. | 216/67 |
| 7,109,503 | B1 * | 9/2006 | Bowering et al. | 250/503.1 |
| 7,247,870 | B2 * | 7/2007 | Ershov et al. | 250/504 R |
| 7,355,191 | B2 * | 4/2008 | Bykanov et al. | 250/504 R |
| 7,365,351 | B2 * | 4/2008 | Bowering et al. | 250/504 R |

(Continued)

FOREIGN PATENT DOCUMENTS

| | | |
|---|---|---|
| JP | 11-288870 | 10/1999 |
| JP | 2004-193468 | 7/2004 |

(Continued)

OTHER PUBLICATIONS

Refusing Reason Notice mailed Oct. 2, 2012 from the Japanese Patent Office in counterpart application No. 2008-148088 with English translation (6 pages).

*Primary Examiner* — Jeffrie R Lund
(74) *Attorney, Agent, or Firm* — Kratz, Quintos & Hanson, LLP

(57) ABSTRACT

A method for cleaning collector mirrors in an EUV light generator in which a target is made into a plasma state and EUV light generated is collected by a collector mirror, the method being adopted to the EUV light generator for cleaning contaminants adhering thereto, the method comprising: preparing at least two collector mirrors; locating one of the mirrors at an EUV light condensing position while locating the other mirror at a cleaning position; determining whether the mirror at the cleaning position is cleaned while determining whether the mirror at the light condensing position requires cleaning; and once determined that the mirror at the cleaning position is cleaned and the mirror at the light condensing position requires cleaning, conveying the mirror at the light condensing position and requiring cleaning to the cleaning position while conveying the mirror at the cleaning position and having been cleaned to the light condensing position.

15 Claims, 8 Drawing Sheets

(56) References Cited

U.S. PATENT DOCUMENTS

| | | | | |
|---|---|---|---|---|
| 8,256,441 | B2 * | 9/2012 | Moriya et al. | 134/186 |
| 2002/0192377 | A1 * | 12/2002 | Bartholomew et al. | 427/255.28 |
| 2006/0163500 | A1 * | 7/2006 | Inoue et al. | 250/493.1 |
| 2006/0174833 | A1 * | 8/2006 | Yamazaki et al. | 118/719 |
| 2006/0192151 | A1 * | 8/2006 | Bowering et al. | 250/503.1 |
| 2006/0260465 | A1 * | 11/2006 | Trestain | 92/165 R |
| 2007/0018122 | A1 * | 1/2007 | Ershov et al. | 250/504 R |
| 2007/0029512 | A1 * | 2/2007 | Bowering et al. | 250/504 R |
| 2007/0068559 | A1 * | 3/2007 | Brody | 134/32 |
| 2009/0301517 | A1 * | 12/2009 | Asayama et al. | 134/1.1 |
| 2010/0025231 | A1 * | 2/2010 | Moriya et al. | 204/192.32 |
| 2010/0192973 | A1 * | 8/2010 | Ueno et al. | 134/1.1 |
| 2012/0298134 | A1 * | 11/2012 | Moriya et al. | 134/1.1 |

FOREIGN PATENT DOCUMENTS

| | | |
|---|---|---|
| JP | 2005-268358 | 9/2005 |
| JP | 2006-202671 | 8/2006 |
| JP | 2006-269941 | 10/2006 |
| JP | 2006-529057 A1 | 12/2006 |
| JP | 2009-088439 | 4/2009 |

* cited by examiner

RELATED ART

METHOD AND APPARATUS FOR CLEANING COLLECTOR MIRROR IN EUV LIGHT GENERATOR

BACKGROUND OF THE INVENTION

1. Technical Field of the Invention

The present invention relates to an EUV light generator for use in a light source such as an exposure device and, in particular, to a method and apparatus for cleaning a collector mirror for collecting EUV light.

2. Related Art

Optical lithography to optically transfer circuit patterns onto semiconductor wafers is important for integration of LSIs. Exposure devices used for the optical lithography are typically of a reduced projection exposure type, which are called steppers. Specifically, an original pattern (reticle) is irradiated with light from an illumination light source, and the transmitted light is projected on a photosensitive material on a semiconductor substrate by a reduced projection optical system to form a circuit pattern. The resolution of this projected image is limited by a wavelength of the used light source. Therefore, the wavelength of the light source has been gradually reduced into the ultraviolet region to meet the needs for further reduction of the pattern line width.

In recent years, KrF excimer lasers (with a wavelength of 248 nm) and ArF excimer lasers (with a wavelength of 193 nm) oscillating light in a deep ultraviolet region (DUV light) have been used as light sources. Further, F2 lasers (with a wavelength of 157 nm) oscillating light in a vacuum ultraviolet region (VUV light) have also been developed as light sources.

Today, attempts are being made to employ, as light sources for the optical lithography, EUV light sources (with a wavelength of 13.5 nm) outputting light in an extreme ultraviolet region (hereafter, referred to as the EUV light) for the purpose of enabling further miniaturization.

The laser-produced plasma (LPP) method is one of methods available for generating EUV light.

An EUV light source employing the LPP method applies short pulse laser light to a target to excite the target into a plasma state, and thereby generates EUV light. The generated EUV light is collected by a collector lens and output to the outside.

FIG. 1 is a conceptual diagram showing a configuration of an LPP-type EUV light generator used as a light source for an exposure device.

A collector mirror 3 for collecting EUV light is provided in the inside of a vacuum chamber 2. The EUV light collected by the collector mirror 3 is transmitted to an exposure device (not shown) outside the vacuum chamber 2. The exposure device uses this EUV light to form a semiconductor circuit pattern on a semiconductor wafer.

The inside of the vacuum chamber 2 is evacuated to form a vacuum state by a vacuum pump or the like. This is because it is only in the vacuum that the EUV light having a wavelength as short as 13.5 nm can be propagated efficiently.

The target 1 serving as an EUV light generation source is located at a predetermined EUV light generation point A within the vacuum chamber 2, that is, at the condensing point of laser light. The target 1 is made of a material such as tin (Sn), lithium (Li), or xenon (Xe).

Laser light L is pulse-oscillated in the driving laser device 4 serving as a laser oscillator and the laser light L is emitted therefrom. A Nd:YAG laser, $CO_2$ laser or the like is used as the laser.

The laser light L is focused at the EUV light generation point A through a laser condensing optical system. The laser light L is applied to the target 1 at the timing when the target 1 is located at the EUV light generation point A. The target 1 is excited to a plasma state by the application of the laser light L to the target 1, and EUV light is generated thereby.

The generated EUV light is scattered in all directions around the plasma. The collector mirror 3 is disposed so as to surround the plasma. The collector mirror 3 collects the EUV light scattered in all directions and reflects the EUV light. The collector mirror 3 selectively reflects the light with a desired wavelength of 13.5 nm. The EUV light reflected by the collector mirror 3 (output EUV light) is transmitted to the exposure device.

A part of the target 1 is split and scattered to produce debris by shock waves during generation of the plasma. The debris includes residue of the target 1 which is left after production of fast ions or plasma.

The scattered debris adheres to the surfaces of optical elements including the collector mirror 3 within the vacuum chamber 2, specifically on the surfaces of the collector mirror 3, a laser condenser lens, a mirror, a laser light entrance window, a SPF (spectrum purity filter), and an entrance window of an optical sensor. This causes a problem of reduction of reflectance and transmittance of the optical elements, resulting in deterioration of the EUV light output, or deterioration of the sensitivity of the optical sensor.

In order to solve this problem, Japanese Patent Application Laid-open (Translation of PCT application) No. 2005-529052 proposes a technique in which ions emitted from plasma are trapped by a magnetic field and discharged out of the vacuum chamber 2. For example, when a $CO_2$ laser is used as the driving laser device 4 for exciting a target, and a metal target of tin (Sn) is used as the target 1, most of the tin (Sn) is converted into a plasma state in which excited multi-charged positive Sn ions are separated from electrons. If a magnetic field is applied to the periphery including this target plasma, positive Sn ions are trapped in the magnetic field, whereby the movement of the positive Sn ions is limited to the direction along the magnetic field lines. Thus, the positive Sn ions can be trapped in the magnetic field and moved in a direction along the magnetic field lines to avoid the optical elements including the collector mirror 3, so that the Sn ions can be prevented from adhering to the optical elements such as the collector mirror, and the Sn ions can be efficiently discharged out of the vacuum chamber 2.

However, the multi-charged positive Sn ions thus generated are apt to be recombined with the generated electrons. Some of the recombined Sn ions are possibly neutralized and adhere as neutral debris to the optical elements including the collector mirror 3 without being trapped by the magnetic field. Additionally, it is difficult to ionize the entire target 1 by means of the driving laser device 4 for exciting the target and a part of the target 1 possibly adheres as neutral particles to the optical elements including the collector mirror 3 without being trapped by the magnetic field.

In order to solve this problem, Japanese Patent Application Laid-open (Translation of PCT application) No. 2006-529057 proposes removing the debris adhering to the collector mirror 3 with the use of a reactive gas or the like.

Among the optical elements within the vacuum chamber 2, it is the collector mirror 3 that is most likely to be contaminated with the debris adhering thereto and is most likely to require cleaning.

Ions adhering to the collector mirror 3 can in principle be removed by cleaning the collector mirror with the use of a reactive gas or the like, as described in Japanese Patent Application Laid-open (Translation of PCT application) No. 2006-529057. After the cleaning, the reflectance of the collector mirror 3 is restored and the collector mirror 3 can be used continuously.

However, the collector mirror 3 must be isolated from the vacuum chamber 2 during the cleaning of the collector mirror 3, and hence the EUV light cannot be collected with the collector mirror 3 during the cleaning process. Further, when the collector mirror 3 has come to the end of its useful life and the cleaning is not helpful anymore, the collector mirror 3 must be replaced with a new one. Again, the EUV light cannot be collected with the collector mirror 3 during the replacement of the collector mirror. Thus, the EUV light generator suffers significant downtime during the cleaning and replacement of the collector mirror.

SUMMARY OF THE INVENTION

The present invention has been made in view of these circumstances, and the problem to be solved by the invention is therefore to reduce the downtime of an EUV light generator caused by cleaning of collector mirrors. The problem to be solved by the invention is also to reduce the downtime of an EUV light generator caused by replacement of collector mirrors.

A first aspect of the invention relates to a method for cleaning collector mirrors in an EUV light generator in which a target is made into a plasma state and EUV light generated is collected by a collector mirror, the method being adopted to the EUV light generator for cleaning contaminants adhering thereto, the method comprising: preparing at least two collector mirrors; locating one of the collector mirrors at an EUV light condensing position while locating the other collector mirror at a cleaning position; determining whether or not the cleaning of the collector mirror located at the cleaning position has been completed while determining whether or not the collector mirror located at the EUV light condensing position requires cleaning; and once it is determined that the cleaning of the collector mirror located at the cleaning position has been completed and it is also determined that the collector mirror located at the EUV light condensing position requires cleaning, conveying the collector mirror located at the EUV light condensing position and requiring cleaning to the cleaning position while conveying the collector mirror located at the cleaning position and having been cleaned to the EUV light condensing position.

A second aspect of the invention relates to the collector mirror cleaning method for use in an EUV light generator according to the first aspect of the invention, the method further comprising: determining whether or not the collector mirror located at the cleaning position has reached the end of its useful life; replacing the collector mirror which is determined to have reached the end of its useful life with a new one; and once the replacement of the collector mirror has been completed and it is determined that the collector mirror located at the EUV light condensing position requires cleaning, conveying the collector mirror located at the EUV light condensing position and requiring cleaning to the cleaning position while conveying the collector mirror having been cleaned to the EUV light condensing position.

A third aspect of the invention relates to a cleaning apparatus for collector mirrors for cleaning contaminants adhering to the collector mirrors in an EUV light generator in which a target is made into a plasma state, EUV light generated is collected by a collector mirror, the cleaning apparatus comprising: at least two collector mirrors; at least one cleaning chamber for cleaning the collector mirrors; conveyor means for conveying the collector mirrors between the cleaning chamber and an EUV light condensing position; cleaning completion determination means for determining whether or not cleaning of the collector mirror has been completed in the cleaning chamber; cleaning necessity determination means for determining whether or not the collector mirror located at the EUV light condensing position requires cleaning; and control means for controlling the conveyor means to convey the collector mirror located at the EUV light condensing position and requiring cleaning to the cleaning chamber while conveying the collector mirror positioned in the cleaning chamber and having been cleaned to the EUV light condensing position, once it is determined that cleaning of the collector mirror has been completed in the cleaning chamber and also determined that the collector mirror located at the EUV light condensing position requires cleaning.

A fourth aspect of the invention relates to the cleaning apparatus for cleaning collector mirrors in an EUV light generator, according to the third aspect of the invention, the apparatus further including: useful time determination means for determining whether or not the collector mirror located at the cleaning position has reached the end of its useful life, wherein the collector mirror determined to have reached the end of its useful life is replaced with a new one; and the control means conveys the collector mirror located at the EUV light condensing position and requiring cleaning to the cleaning position while conveying the collector mirror having been cleaned to the EUV light condensing position once it is determined that the replacement of the collector mirror has been completed and the collector mirror located at the EUV light condensing position requires cleaning.

A fifth aspect of the invention relates to the cleaning apparatus for cleaning collector mirrors in an EUV light generator, according to the third aspect of the invention, wherein: the cleaning chamber is provided in association with each of at least two collector mirrors; the conveyor means is provided in association with each of the at least two collector mirrors; and the control means activates the conveyor means associated with the collector mirror located at the EUV light condensing position and requiring cleaning to convey this collector mirror to the cleaning chamber, while activating the conveyor means associated with the collector mirror positioned in the cleaning chamber and having been cleaned to convey this collector mirror to the EUV light condensing position.

A sixth aspect of the invention relates to the cleaning apparatus for cleaning collector mirrors in an EUV light generator, according to the third aspect of the invention, wherein the cleaning of the collector mirror is performed by supplying, to the collector mirror, a reactive gas which is reactive with contaminants adhering to the collector mirror.

A seventh aspect of the invention relates to the cleaning apparatus for cleaning collector mirrors in an EUV light generator, according to the sixth aspect of the invention, wherein the reactive gas is a gas selected from a group consisting of $H_2$, Ar, $N_2$, $F_2$, $Cl_2$, $Br_2$, $I_2$, HF, HCl, HBr, HI, and a mixture thereof.

An eighth aspect of the invention relates to the cleaning apparatus for cleaning collector mirrors in an EUV light generator, according to the sixth aspect of the invention, and the apparatus further includes reaction acceleration means for accelerating a reaction between the reactive gas and the contaminants adhering to the collector mirror.

A ninth aspect of the invention relates to the cleaning apparatus for cleaning collector mirrors in an EUV light generator, according to the eighth aspect of the invention, wherein the reaction acceleration means accelerates the reaction between the reactive gas and the contaminants adhering to the collector mirror by heating the collector mirror or/and the reactive gas, or/and by converting the reactive gas into plasma.

A tenth aspect of the invention relates to the cleaning apparatus for cleaning collector mirrors in an EUV light generator, according to the third aspect of the invention, wherein the cleaning chamber is provided with a gate valve for allowing or blocking communication between the cleaning chamber and an EUV chamber for generating EUV light.

An eleventh aspect of the invention relates to the cleaning apparatus for cleaning collector mirrors in an EUV light generator, according to the third aspect of the invention, wherein the cleaning chamber is caused to communicate with the atmospheric air by being differentially pumped by a differential pumping device.

A twelfth aspect of the invention relates to the cleaning apparatus for cleaning collector mirrors in an EUV light generator, according to the fourth aspect of the invention, wherein the cleaning chamber communicates with a load lock chamber.

A thirteenth aspect of the invention relates to the cleaning apparatus for cleaning collector mirrors in an EUV light generator, according to the third aspect of the invention, wherein: the conveyor means comprises a rotating body having at least two collector mirrors disposed on the same rotary surface thereof, and a rotating shaft for rotating the rotating body; and the control means causes the rotating shaft to rotate so as to position the collector mirrors disposed on the same rotary surface in the cleaning chamber and at the EUV light condensing position, respectively.

A fourteenth aspect of the invention relates to the cleaning apparatus for cleaning collector mirrors in an EUV light generator, according to the third aspect of the invention, wherein: the conveyor means comprises a rotating plate having two collector mirrors disposed on its front and rear surfaces, respectively, and a rotating shaft for rotating the rotating plate such that the front and rear surfaces rotate to reverse their positions each other; and the control means causes the rotating shaft to rotate so as to position the collector mirrors disposed on the front and rear surfaces of the rotating plate in the cleaning chamber and at the EUV light condensing position, respectively.

A fifteenth aspect of the invention relates to the cleaning apparatus for cleaning collector mirrors in an EUV light generator, according to the fifth aspect of the invention, wherein the conveyor means is a transfer rod for linearly moving the collector mirror reciprocally between the EUV light condensing position and the cleaning chamber.

A sixteenth aspect of the invention relates to the cleaning apparatus for cleaning collector mirrors in an EUV light generator, according to the fifth aspect of the invention, wherein the conveyor means is a conveyor robot for conveying the collector mirror between the EUV light condensing position and the cleaning chamber.

A seventeenth aspect of the invention relates to the cleaning apparatus for cleaning collector mirrors in an EUV light generator, according to the fifth aspect of the invention, wherein the conveyor means is a movable stage for placing the collector mirror thereon and reciprocally moving the collector mirror between the EUV light condensing position and the cleaning chamber.

An eighteenth aspect of the invention relates to the cleaning apparatus for cleaning collector mirrors in an EUV light generator, according to the fifth aspect of the invention, wherein the conveyor means uses a wire to move the collector mirror reciprocally between the EUV light condensing position and the cleaning chamber.

A nineteenth aspect of the invention relates to the cleaning apparatus for cleaning collector mirrors in an EUV light generator, according to the third aspect of the invention, wherein the cleaning completion determination means determines whether or not the cleaning of the collector mirror has been completed and whether or not the collector mirror requires cleaning by measuring the film thickness of the collector mirror with the use of a quartz crystal microbalance measurement method or/and a spectroscopic ellipsometry, or/and by measuring the reflectance of the collector mirror, or/and by measuring the concentrations of the contaminants and the reactive gas, or/and by measuring the period of time required for the cleaning.

A twentieth aspect of the invention relates to the cleaning apparatus for cleaning collector mirrors in an EUV light generator, according to the fourth aspect of the invention, wherein the useful time determination means determines whether or not the collector mirror has reached the end of its useful life by measuring the film thickness of the collector mirror with the use of a quartz crystal microbalance measurement method or/and a spectroscopic ellipsometry, or/and by measuring the reflectance of the collector mirror, or/and by measuring the concentrations of the contaminants and the reactive gas, or/and by measuring the period of time required for the cleaning.

According to the first aspect of the invention, as shown in FIG. 2, once it is determined that the cleaning of the collector mirror 3-2 located at the cleaning position C2 has been completed and that the collector mirror 3-1 located at the EUV light condensing position M requires cleaning, the collector mirror 3-1 located at the EUV light condensing position M and requiring cleaning is conveyed to the cleaning position C1 while the collector mirror 3-2 located at the cleaning position C2 and having been cleaned is conveyed to the EUV light condensing position M. According to this configuration, when the collector mirror 3-2 is being cleaned, the other collector mirror 3-1 can be used to collect the EUV light. When the collector mirror 3-1 that has been used for collecting the light requires cleaning, the collector mirror 3-1 can be promptly cleaned. Further, the collector mirror 3-2 having been cleaned can be promptly used for collecting the EUV light. This makes it possible to reduce the downtime of the EUV light generator caused by the cleaning of the collector mirror 3.

According to the second aspect of the invention, when it is determined that the collector mirror 3-2 located at the cleaning position C2 has reached the end of its useful life, the collector mirror 3-2 determined to have reached the end of its useful time is replaced with a new one. Once the collector mirror 3-2 has been replaced and it is determined that the collector mirror 3-1 located at the EUV light condensing position M requires cleaning, the collector mirror 3-1 located at the EUV light condensing position M and requiring cleaning is conveyed to the cleaning position C1 while the collector mirror 3-2 which has been replaced with the old one is conveyed to the EUV light condensing position M. According to this configuration, when the collector mirror 3-2 is being replaced, the other collector mirror 3-1 can be used to collect the EUV light. When the collector mirror 3-1 which has been used for collecting the EUV light requires cleaning, the collector mirror 3-1 can be promptly cleaned, and the other collector mirror 3-2 which has been replaced with the old one can be used promptly for collecting the EUV light. This makes it possible to reduce the downtime caused by replacement of the collector mirror 3.

The third aspect of the invention is an apparatus invention corresponding to the method invention of the first aspect of the invention.

The fourth aspect of the invention is an apparatus invention corresponding to the method invention of the second aspect of the invention.

In the fifth aspect of the invention, as shown FIG. 2, cleaning chambers 21 and 22 are provided in association with at least two collector mirrors 3-1 and 3-2, respectively. Conveyor means 31 and 32 are also provided in association with at least two collector mirrors 3-1 and 3-2, respectively.

The control means 50 activates the conveyor unit 31 associated with the collector mirror 3-1 located at the EUV light condensing position M and requiring cleaning to convey this collector mirror 3-1 to the cleaning chamber 21, while activating the conveyor unit 32 associated with the collector mirror 3-2 positioned in the cleaning chamber 22 and having been cleaned to convey this collector mirror 3-2 to the EUV light condensing position M.

In the sixth aspect of the invention, the cleaning of the collector mirror 3 is performed by supplying, to the collector mirror 3, a reactive gas G which is reactive with contaminants adhering to the collector mirror 3.

In the seventh aspect of the invention, the reactive gas G is a gas selected from the group consisting of $H_2$, Ar, $N_2$, $F_2$, $Cl_2$, $Br_2$, $I_2$, HF, HCl, HBr, HI, and a mixture thereof.

In the eighth aspect of the invention, a reaction acceleration means accelerates the reaction between the reactive gas G and the contaminant adhering to the collector mirror 3. This reduces the period of time required for cleaning the collector mirror 3.

In the ninth aspect of the invention, a reaction acceleration means accelerates the reaction between the reactive gas G and the contaminants adhering to the collector mirror 3 by heating the collector mirror 3 or/and the reactive gas G, or/and converting the reactive gas G into plasma. This reduces the period of time required for cleaning the collector mirror 3.

In the tenth aspect of the invention, as shown in FIG. 2, the cleaning chambers 21 and 22 are respectively provided with gate valves GV1 and GV2 for allowing or blocking the communication with the EUV chamber 2 in which EUV light is generated. When the communication is blocked by the gate valves GV1 and GV2, the atmosphere in the cleaning chambers 21 and 22 is isolated from the atmosphere in the EUV chamber 2 during cleaning of the collector mirror 3 and during generation of the EUV light. This ensures that the cleaning of the collector mirror 3 and the generation of the EUV light can be performed in a favorable manner. Further, when the communication is allowed by the gate valves GV1 and GV2, the collector mirror 3 can be conveyed to a desired conveyance position.

In the eleventh aspect of the invention, the cleaning chambers 21 and 22 are caused to communicate with the atmospheric air by being differentially pumped by a differential pumping device.

In the twelfth aspect of the invention, as shown in FIG. 6, the cleaning chambers 21 and 22 communicate with the atmospheric air through load lock chambers 41 and 42. Therefore, the collector mirror 3 can be replaced in the load lock chambers 41 and 42, whereby the entry of the atmospheric air into the cleaning chambers 21 and 22 can be prevented during the replacement of the collector mirror.

In the thirteenth aspect of the invention, as shown in FIG. 7, the conveyor means 30 includes a rotating body 35 having at least two collector mirrors 3-1 and 3-2 disposed on the same rotary surface 35A thereof, and a rotating shaft 35B for rotating the rotating body 35. The control means 50 rotates the rotating shaft 35B to position the collector mirrors 3-1 and 3-2 on the same rotary surface 35A in the cleaning chamber 20 and at the EUV light condensing position M, respectively. According to the thirteenth aspect of the invention, the apparatus can be formed with a single conveyor means 30 and can be formed with a single cleaning chamber 20.

In the fourteenth aspect of the invention, as shown in FIG. 8, the conveyor means 30 includes a rotating plate 36 having two collector mirrors 3-1 and 3-2 disposed on its front surface 36A and rear surface 36B, respectively, and a rotating shaft 36C for rotating the rotating plate 36 such that the front and rear surfaces 36A and 36B rotate in opposite directions to each other. The control means 50 rotates the rotating shaft 36C to position the collector mirror 3-1 on the front surface 36A of the rotating plate 36 and the collector mirror 3-2 on the rear surface 36B in the cleaning chamber and at the EUV light condensing position, respectively. According to the fourteenth aspect of the invention, the apparatus can be formed with a single conveyor means 30 and formed with a single cleaning chamber 20.

In the fifteenth aspect of the invention, as shown in FIG. 2, the collector mirror 3-1 is linearly moved by a transfer rod 31 as the conveyor means 30 reciprocally between the EUV light condensing position M and the cleaning chamber 21, while the collector mirror 3-2 is linearly moved by a transfer rod 32 as the conveyor means 30 reciprocally between the EUV light condensing position M and the cleaning chamber 22.

In the sixteenth aspect of the invention, as shown in FIG. 6, the collector mirror 3-1 is conveyed by a conveyor robot 33 as the conveyor means 30 between the EUV light condensing position M and the cleaning chamber 21, while the collector mirror 3-2 is conveyed by a conveyor robot 34 as the conveyor means 30 between the EUV light condensing position M and the cleaning chamber 22.

In the seventeenth aspect of the invention, the conveyor means 30 is formed by a movable stage. The collector mirror 3 is placed on the movable stage and is moved reciprocally between the EUV light condensing position M and the cleaning chamber 20.

In the eighteenth aspect of the invention, the conveyor means 30 is formed by a wire, and the collector mirror 3 is moved reciprocally between the EUV light condensing position M and the cleaning chamber 20 by using the wire.

In the nineteenth aspect of the invention, the cleaning completion determination means 51 determines whether or not the cleaning of the collector mirror 3 has been completed by measuring the film thickness of the collector mirror with the use of a quartz crystal microbalance measurement method or/and a spectroscopic ellipsometry, or/and by measuring the reflectance of the collector mirror, or/and by measuring the concentrations of the contaminants and the reactive gas, or/and by measuring the period of time required for the cleaning.

In the twentieth aspect of the invention, the useful time determination means 53 determines whether or not the collector mirror 3 has reached the end of its useful life by measuring the film thickness of the collector mirror with the use of a quartz crystal microbalance measurement method or/and a spectroscopic ellipsometry, or/and by measuring the reflectance of the collector mirror, or/and by measuring the concentrations of the contaminants and the reactive gas, or/and by measuring the period of time required for the cleaning.

DETAILED DESCRIPTION OF THE INVENTION

Embodiments of a method and apparatus for cleaning a collector mirror in an EUV light generator according to the present invention will be described with reference to the accompanying drawings.

Figure 2:
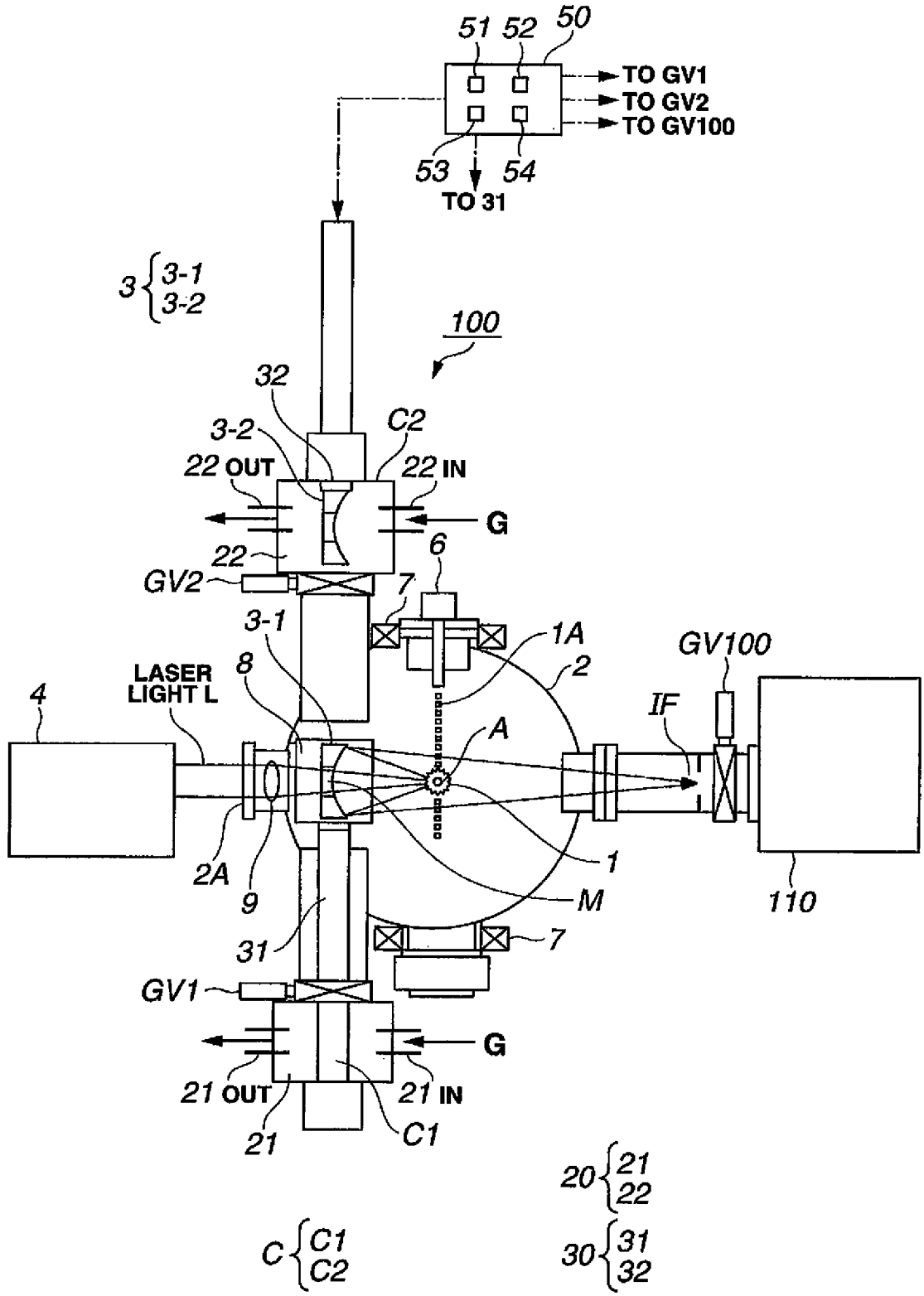
FIG. 2 is a diagram showing a configuration example of an apparatus according an embodiment of the invention in which a transfer rod is used as conveyance means.

FIG. 2 shows a configuration of a cleaning apparatus according to an embodiment of the invention.

Figure 1:
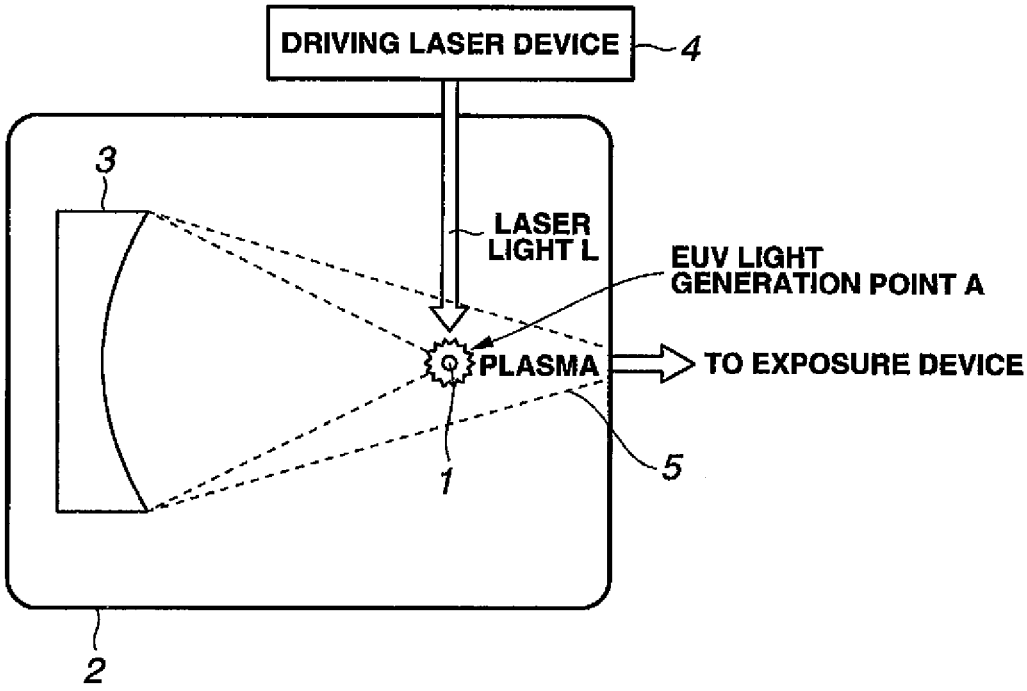
FIG. 1 is a conceptual diagram for explaining a related art and showing a configuration of a LPP-type EUV light generator used as a light source for an exposure device.

Like the apparatus shown in FIG. 1, an EUV light generator 100 shown in FIG. 2 is designed such that a target 1 located at an EUV light generation point A is converted into a plasma state to generate EUV light and the generated EUV light is output externally. It is assumed in the following description that the EUV light generator 100 is provided with two collector mirrors 3 which are distinguished from each other while being assigned with the reference numerals 3-1 and 3-2, respectively. If these two collector mirrors 3-1 and 3-2 are to be referred to collectively without being distinguished from each other, they shall be referred to as the collector mirrors 3. Likewise, two cleaning chambers 20 are provided and these cleaning chambers are distinguished from each other while being assigned with the reference numerals 21 and 22, respectively. Likewise, two conveyor units 30 are provided and these conveyor units are distinguished from each other while being assigned with the reference numerals 31 and 32, respectively.

This EUV light generator 100 is a LPP-type EUV light generator to be used as a light source for an exposure device 110.

Specifically, a collector mirror 3 for collecting EUV light is provided in the inside of a vacuum chamber 2 of the EUV light generator 100. EUV light collected by the collector mirror 3 is transmitted to an exposure device 110 outside the vacuum chamber 2, in the same manner as the apparatus shown in FIG. 1. In the exposure device 110, a semiconductor circuit pattern is formed on a semiconductor wafer by using the EUV light.

The inside of the vacuum chamber 2 is evacuated by a vacuum pump or the like to form a vacuum state. The gas within the vacuum chamber 2 is discharged to the outside by an exhaust device not shown. The vacuum state is created in the space where EUV light is generated because it is only in the vacuum that the EUV light having a wavelength as short as 13.5 nm can be propagated efficiently.

A target 1 serving as an EUV light generation source is converted into droplets 1A, which are supplied to a predetermined EUV light generation point A within the vacuum chamber 2, that is, to the condensing point of laser light L. A target supplying device 6 emits the droplets 1A toward the EUV light generation point A such that the droplets 1A fall vertically downward.

The droplets 1A are made of tin (Sn), for example. The target supplying device 6 thermally dissolves solid tin (Sn) to form solid or liquid droplets 1A, and supplies these droplets 1A to the EUV light generation point A.

Laser light L is pulse-oscillated in a driving laser device 4 serving as a laser oscillator, and emitted therefrom. The laser may be a $CO_2$ laser, for example. Other lasers such as a Nd:YAG laser may be used instead. For example, the driving laser device 4 may oscillate and output a high-power $CO_2$ pulse laser light L (for example, with an output of 20 kW, a pulse repetition frequency of 100 kHz, and a pulse width of 20 nsec) for exciting the target 1.

The laser light L is focused at the EUV light generation point A via a laser condensing optical system 9 comprising a window 2A of the vacuum chamber 2, the condenser lens, and so on. The laser light L is applied to the target 1 at the timing when the target 1 in the droplets 1A is located at the EUV light generation point A. The target 1 is excited into a plasma state by the application of the laser light L to the target 1 and EUV light (with a central wavelength of 13.5 nm) is generated.

The generated EUV light is scattered in all directions around the plasma. However, the radiation intensity distribution of the EUV light is dependent on an incident direction of the laser light, and relatively strong EUV light is radiated in the direction opposite to the laser light incident direction.

The collector mirror 3 is disposed so as to surround the plasma. The collector mirror 3 is disposed opposite to the incident direction of the laser light. The collecting surface 3A of the collector mirror 3 is formed into an elliptical shape. This allows the collector mirror 3 to efficiently collect and reflect the EUV light which is scattered in all directions but is emitted relatively strongly in the direction opposite to the laser light incident direction. The collector mirror 3 selectively reflects light having a desired wavelength of 13.5 nm. The collector mirror 3 is coated with a layer (for example, a Mo/Si layer) having a high reflectance for wavelengths around 13.5 nm. The EUV light reflected by the collector mirror 3 (output EUV light) is transmitted to an exposure device 110 via an intermediate focus point IF Although not shown in the figure, a spectrum purity filter (SPF) may be provided before or after the intermediate focus point IF so as to cut off unnecessary light for EUV exposure, that is, light having wavelengths other than the central wavelength of 13.5 nm.

A gate valve GV100 is provided between the vacuum chamber 2 and the exposure device 110. The gate valve GV100 is opened to allow communication between the vacuum chamber 2 and the exposure device 110 during the generation of the EUV light. When the EUV light generator 100 or the exposure device 110 is under maintenance, the gate valve GV100 is closed to block the communication between the vacuum chamber 2 and the exposure device 110 so that they are isolated from each other.

The target 1 is excited by the laser light L and partially converted into plasma. The plasma comprises electrons, multi-charged positive Sn ions ($Sn^+$), and Sn radicals (Sn*).

A magnetic field line generator 7 generates magnetic field lines in a direction vertical to the incident direction of the laser light L.

The optical elements within the vacuum chamber 2, namely the collector mirror 3, the window 2A, the SPF, and the entrance window of the optical sensor are disposed along a direction perpendicular to the magnetic field lines.

The magnetic field line generator 7 includes a superconducting magnet, for example, so that a magnetic field of about 0.01 to 1 T, for example, is generated by the superconducting magnet to thereby generate magnetic field lines.

Multi-charged positive Sn ions ($Sn^+$) are emitted from the plasma. The $Sn^+$ ions which are electrically charged particles are given by the magnetic field the Lorentz force F(=qv×B, where q denotes the charge of the $Sn^+$ ions, v denotes the velocity of the $Sn^+$ ions, and B denotes the magnetic flux density in the magnetic field). This causes the $Sn^+$ ions to wind around the magnetic field lines and to move along the direction of the magnetic field lines while whirling with a predetermined Lamor radius. This confinement of the $Sn^+$ ions by the magnetic field prevents the $Sn^+$ ions from adhering to the surfaces of the collector mirror 3, the window 2A, the SPF, the entrance window of the optical sensor, and other optical elements within the vacuum chamber 2. However, the $Sn^+$ ions are prone to be recombined with electrons. The $Sn^+$ ions recombined with some of the electrons are electrically neutralized and may adhere as neutral Sn debris to the optical elements as mentioned above, particularly to the collector mirror, without being trapped by the magnetic field.

In addition, it is difficult to ionize the entire target 1 with the use of the target-exciting laser light L. A part of the target 1 may possibly adhere as electrically neutral particles to the optical elements as mentioned above, particularly to the collector mirror, without being trapped by the magnetic field.

Since the Sn radicals (Sn*) emitted from the plasma are also electrically neutral, they may adhere to the optical elements, particularly to the collector mirror 3, without being trapped by the magnetic field.

According to this embodiment, two collector mirrors 3 (collector mirrors 3-1 and 3-2) are provided, and cleaning chambers 21 and 22 are provided in association with the two collector mirrors 3-1 and 3-2, respectively. Conveyor units 31 and 32 are provided in association with the two collector mirrors 3-1 and 3-2, respectively. The collector mirror 3-1 located at the EUV light condensing position M and requiring cleaning is conveyed into the cleaning chamber 21 by activating a transfer rod 31 associated therewith, while the collector mirror 3-2 located in the cleaning chamber 22 and having been cleaned is conveyed to the EUV light condensing position M by activating a transfer rod 32 associated therewith.

According to this embodiment, the transfer rods 31 and 32 are provided as the conveyor units 31 and 32 in association with the collector mirrors 3-1 and 3-2, respectively. The collector mirror 3-1 is linearly moved by the transfer rod 31 reciprocally between the EUV light condensing position M and the cleaning chamber 21, while the collector mirror 3-2 is linearly moved by the transfer rod 32 reciprocally between the EUV light condensing position M and the cleaning chamber 22.

In other words, the transfer rods 31 and 32 are provided so as to be reciprocally and linearly movable in a direction perpendicular to the incident direction of the laser light L. The collector mirror 3-1 is connected to a distal end of the transfer rod 31, while the collector mirror 3-2 is connected to a distal end of the transfer rod 32.

The transfer rod 31 linearly moves the collector mirror 3-1 reciprocally between the EUV light condensing position M and a cleaning position C1 within the cleaning chamber 21.

Likewise, the transfer rod 32 linearly moves the collector mirror 3-2 reciprocally between the EUV light condensing position M and a cleaning position C2 within the cleaning chamber 22.

The term "EUV light condensing position M" as used herein means a position of the collector mirror 3 where the EUV light can be condensed and the reflected EUV light (output EUV light) can be transmitted to the exposure device 110 via the intermediate focus point IF.

The term "cleaning position C1" means a position where the collector mirror 3-1 can be cleaned within the cleaning chamber 21. Likewise, the term "cleaning position C2" means a position where the collector mirror 3-2 can be cleaned within the cleaning chamber 22.

The cleaning chamber 21 is provided with a gate valve GV1 for either allowing or blocking communication with the vacuum chamber 2. When the gate valve GV1 is closed, the communication is blocked between the cleaning chamber 21 and the vacuum chamber 2, whereby the atmosphere within the cleaning chamber 2 is isolated from the atmosphere within the vacuum chamber 2 during cleaning of the collector mirror 3-1 and during generation of the EUV light. Accordingly, the cleaning of the collector mirror 3-1 and the generation of the EUV light can be performed in a desirable manner. When the gate valve GV1 is opened, the cleaning chamber 21 communicates with the vacuum chamber 2, and the collector mirror 3-1 can be conveyed to a desired conveyance position.

Likewise, the cleaning chamber 22 is provided with a gate valve GV2 for allowing or blocking communication with the vacuum chamber 2. When the gate valve GV2 is closed, the communication between the cleaning chamber 22 and the vacuum chamber 2 is blocked, whereby the atmosphere within the cleaning chamber 22 is isolated from the atmosphere within the EUV chamber 2 during cleaning of the collector mirror 3-2 and during generation of the EUV light. Accordingly, the cleaning of the collector mirror 3-2 and the generation of the EUV light can be performed in a desirable manner. When the gate valve GV2 is opened, the cleaning chamber 22 communicates with the vacuum chamber 2, and the collector mirror 3-2 can be conveyed to a desired conveyance position.

The cleaning of the collector mirror 3 is performed by supplying to the surface of the collector mirror 3 a reactive gas G which is reactive with debris or other contaminants adhering to the collector mirror 3. The reactive gas G is supplied through respective gas supply ports 21IN and 22IN of the cleaning chambers 21 and 22, and discharged from respective gas exhaust ports 21OUT and 22OUT of the cleaning chambers 21 and 22.

The reactive gas G may be any one of H2, Ar, N2, F2, $Cl_2$, $Br_2$, $I_2$, HF, HCl, HBr, and HI, or a mixed gas thereof.

The reactive gas G reacts with the debris or other contaminants, and a reaction product thus produced is discharged from the gas exhaust ports 21OUT and 22OUT. Particularly, $H_2$, $Cl_2$, $Br_2$, HCl, or HBr gas reacts with the Sn debris to produce a reaction product such as $SnH_4$, $SnCl_4$, or $SnBr_4$ which has such a low vapor pressure as to gasify within the vacuum chamber 2. The gasified reaction product can be easily discharged from the gas exhaust ports 21OUT and 22OUT by means of a vacuum pump or the like.

A reaction acceleration means may be provided. The reaction acceleration means accelerates the reaction between the reactive gas G and the contaminants adhering to the collector mirror 3 by increasing the reaction velocity. This makes it possible to shorten the period of time required to clean the collector mirror 3. The reaction acceleration means may be means for heating the collector mirror 3 to thereby accelerate the reaction between the reactive gas G and the contaminants adhering to the collector mirror 3. Alternatively, the reaction acceleration means may be means for heating the reactive gas G to thereby accelerate the reaction between the reactive gas G and the contaminants adhering to the collector mirror 3. Further alternatively, the reaction acceleration means may be means for converting the reactive gas G into plasma to thereby accelerate the reaction between the reactive gas G and the contaminants adhering to the collector mirror 3. These means may be combined as required.

The cleaning chambers 21 and 22 may be caused to communicate with the atmospheric air by differentially evacuating the chambers by means of a differential pumping device.

The transfer rods 31 and 32 are controlled by a controller 50 serving as control means.

The controller 50 has a cleaning termination determination portion 51, a cleaning necessity determination portion 52, a useful life determination portion 53, and a conveyance control portion 54.

The cleaning termination determination portion 51 determines that the cleaning of the collector mirror 3 has been completed in the cleaning chamber 21 or 22.

The cleaning necessity determination portion 52 determines that the collector mirror 3 located at the EUV light condensing position M requires cleaning.

The useful life determination portion 53 determines that the collector mirror 3 located in the cleaning chamber 21 or 22 has reached the end of its useful life.

The cleaning necessity determination portion 52 is capable of determining the necessity of cleaning by measuring the film thickness of the collector mirror 3 with the use of the quartz crystal microbalance measurement method. The cleaning necessity determination portion 52 is also capable of determining the necessity of cleaning by measuring the film thickness of the collector mirror 3 with the use of the spectroscopic ellipsometry. Further, the determination can be made by measuring the reflectance of the collector mirror 3.

The cleaning termination determination portion 51 and the useful life determination portion 53 are capable of making respective determinations by measuring the film thickness of the collector mirror 3 with the use of the quartz crystal microbalance measurement method. The determinations also may be made by measuring the film thickness of the collector mirror 3 with the use of the spectroscopic ellipsometry. Further, the determinations also may be made by measuring the reflectance of the collector mirror 3. Still further, the determinations may be made by measuring the concentrations of the contaminant and the reactive gas G. Still further, the determinations also may be made by measuring the period of time required for the cleaning.

Once it is determined that the cleaning of the collector mirror 3-1 has been completed in the cleaning chamber 21 and it is also determined that the collector mirror 3-2 located at the EUV light condensing position M requires cleaning, the conveyance control portion 54 controls the transfer rods 31 and 32 such that the collector mirror 3-2 located at the EUV light condensing position M and requiring cleaning is conveyed to a cleaning position C2 within the cleaning chamber 22, and the collector mirror 3-1 located at the cleaning position C1 within the cleaning chamber 21 and having been cleaned is conveyed to the EUV light condensing position M. Likewise, once it is determined that the cleaning of the collector mirror 3-2 has been completed in the cleaning chamber 22 and that the collector mirror 3-1 located at the EUV light condensing position M requires cleaning, the conveyance control portion 54 controls the transfer rods 31 and 32 such that the collector mirror 3-1 located at the EUV light condensing position M and requiring cleaning is conveyed to the cleaning position C1 within the cleaning chamber 21, and the collector mirror 3-2 located at the cleaning position C2 within the cleaning chamber 22 and having been cleaned is conveyed to the EUV light condensing position M.

Further, once it is determined that the collector mirror 3-1 has been replaced and the collector mirror 3-2 located at the EUV light condensing position M requires cleaning, the conveyance control portion 54 controls the transfer rods 31 and 32 such that the collector mirror 3-2 located at the EUV light condensing position M and requiring cleaning is conveyed to the cleaning position C2 in the cleaning chamber 22 and the collector mirror 3-1 which has been replaced with the old one is conveyed to the EUV light condensing position M. Likewise, once it is determined that the collector mirror 3-2 has been replaced and the collector mirror 3-1 located at the EUV light condensing position M requires cleaning, the conveyance control portion 54 controls the transfer rods 31 and 32 such that the collector mirror 3-1 located at the EUV light condensing position M and requiring cleaning is conveyed to the cleaning position C1 in the cleaning chamber 21 and the collector mirror 3-2 which has been replaced with the old one is conveyed to the EUV light condensing position M.

Figure 3A:
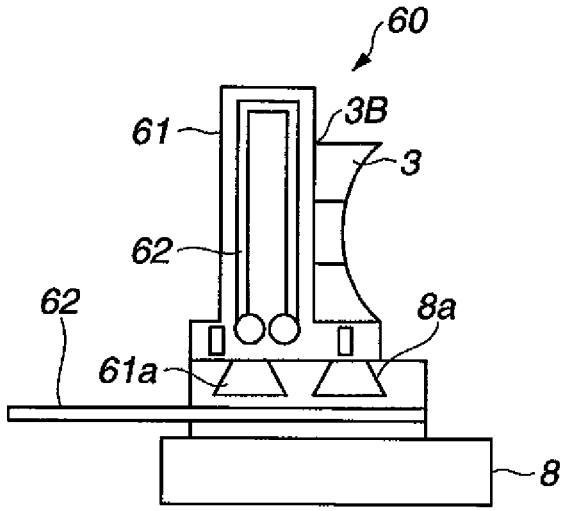
FIGS. 3A to 3C are cross-sectional views for explaining a positioning mechanism.
Figure 3B:
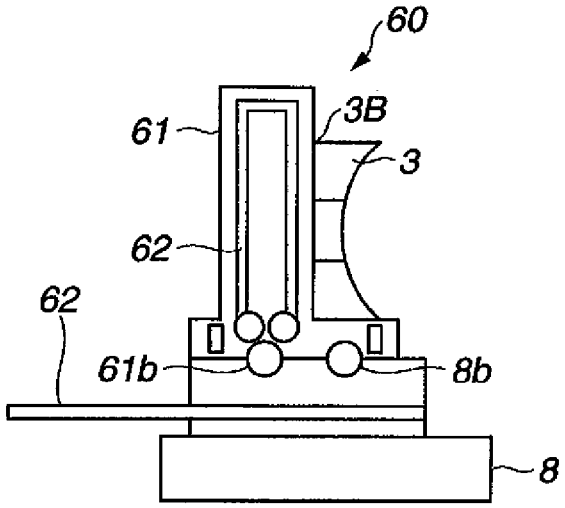
Figure 3C:
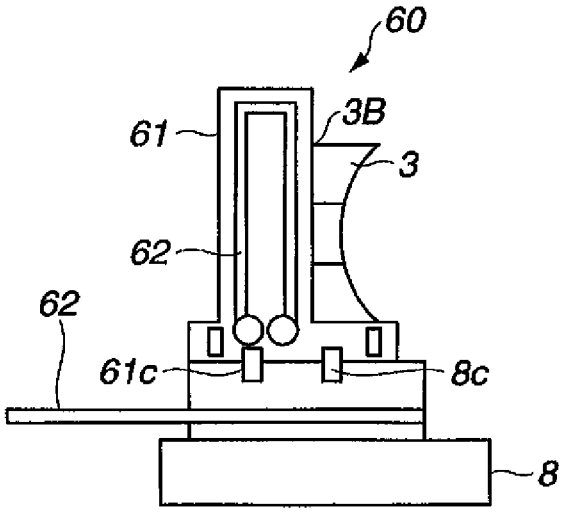

The collector mirror 3 is placed at a correct position on a mirror alignment stage 8 to collect the EUV light with a high efficiency. FIGS. 3A to 3C show a positioning mechanism 60 for positioning the collector mirror 3 on the mirror alignment stage 8 with a high positioning accuracy.

FIG. 3A shows a positioning mechanism 60 having a dovetail groove structure in which trapezoidal male components and female components are in slidable surface contact with each other. Specifically, female holes 8*a* having a trapezoidal cross section are formed in the mirror alignment stage 8. On the other hand, male components 61*a* having a trapezoidal shape corresponding to the shape of the female holes 8*a* are formed on a fastening component 61, and these male components 61*a* are fitted in the female holes 8*a*. The fastening component 61 and the mirror alignment stage 8 are provided with a coolant passage 62 for cooling the collector mirror 3.

When the collector mirror 3-1 or 3-2 is conveyed to the EUV light condensing position M by the transfer rod 31 or 32, the back surface 3B of the collector mirror comes into contact with the fastening component 61. As a result, the collector mirror 3-1 or 3-2 is positioned on the mirror alignment stage 8 with a high positioning accuracy.

When the collector mirror 3 is located at the EUV light condensing position M, a coolant flows through the coolant passage 62. This cools the collector mirror 3 and improves the luminous efficiency of the EUV light. The collector mirror 3 may be cooled by providing a heat exchanger instead of such a cooling device using the coolant. Further, a heat exchanger may be provided not only for cooling the collector mirror 3 but also for promoting the reaction between the reactive gas G and the contaminants adhering to the collector mirror 3. This means that the collector mirror 3 can be heated to promote the reaction between the reactive gas G and the contaminants adhering to the collector mirror 3 and thus to reduce the period of time required for the cleaning.

Although FIG. 3A shows the positioning mechanism 60 having a dovetail groove structure as an example, any other structure may be employed for the positioning.

FIG. 3B shows a positioning mechanism 60 having a structure in which the fastening component 61 is provided with steel balls 61*b* and the mirror alignment stage 8 is provided with round grooves 8*b*, instead of the male components 61*a* and the female holes 8*a* in FIG. 3A. Instead of the round grooves, the mirror alignment stage 8 may be provided with V grooves or bowl-shaped grooves or a mixture of such grooves.

FIG. 3C shows a positioning mechanism 60 having a structure in which the fastening component 61 is provided with positioning pins 61*c* and the mirror alignment stage 8 is provided with pin holes 8*c*, instead of the male components 61*a* and the female holes 8*a* in FIG. 3A.

It may also be possible to provide guide rails for ensuring the positional accuracy of the collector mirror 3 during the conveyance thereof.

Figure 4A:
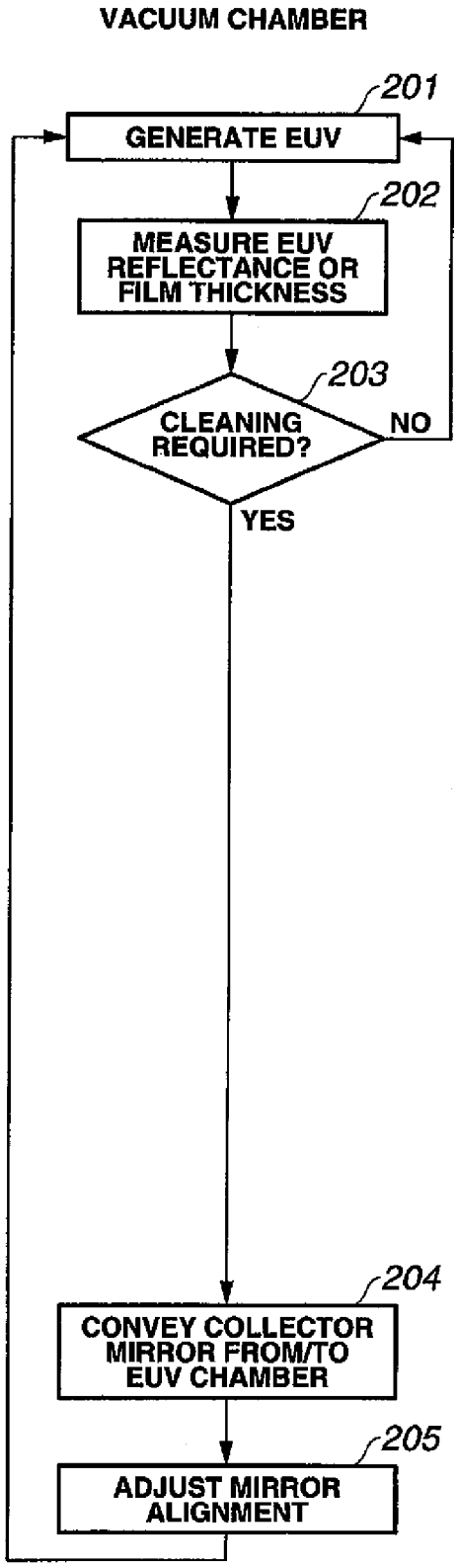
FIGS. 4A and 4B are flowcharts showing processing steps performed by a controller.
Figure 4B:
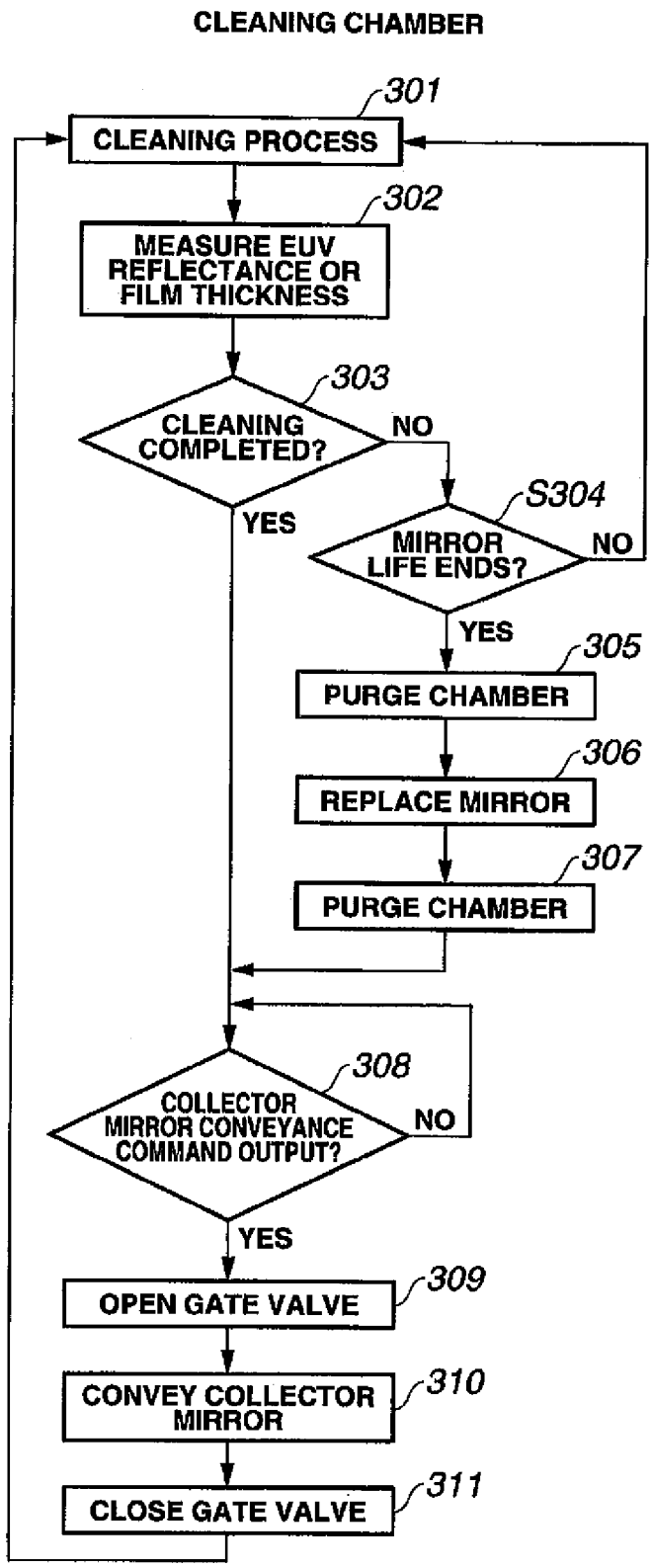

FIGS. 4A and 4B are flowcharts showing processing steps performed by the controller 50. FIG. 4A shows the processing steps relating to the collector mirror 3 located at the EUV light condensing position M in the vacuum chamber 2, while FIG. 4B shows the processing steps relating to the collector mirror 3 located at the cleaning position C1 or C2 in the cleaning chamber 21 or 22.

Figure 5:
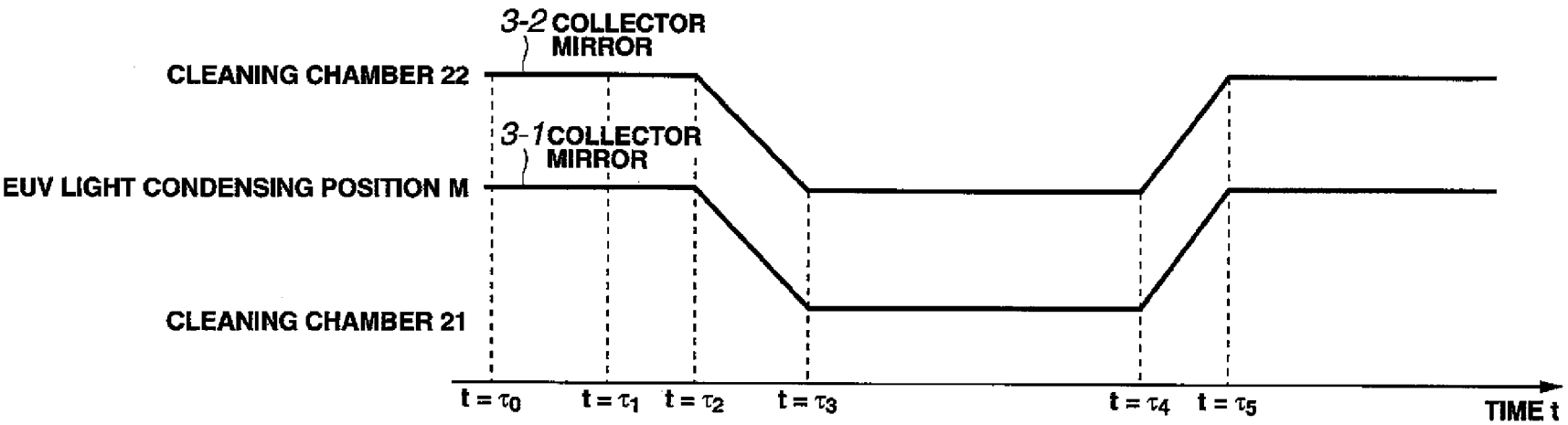
FIG. 5 is a diagram showing conveyance positions of collector mirrors in time series.

FIG. 5 is a diagram for explaining the flow of control according to the embodiment, showing variation in the conveyance positions of the collector mirrors 3-1 and 3-2 in time series. The following description will be made with reference to these figures together.

It is assumed here that at time t=τ0 the collector mirror 3-1 is located at the EUV light condensing position M in the vacuum chamber 2 and the collector mirror 3-2 is located at the cleaning position C2 in the cleaning chamber 22, as shown in FIG. 2.

EUV light is generated at the EUV light generation point A in the vacuum chamber 2, the generated EUV light is collected by the collector mirror 3-1, and the EUV light reflected by the collector mirror 3-1 is guided to the exposure device 110 (step 201).

A measurement is conducted on the collector mirror 3-1 to determine whether or not the collector mirror 3-1 requires cleaning. Specifically, the measurement is conducted by using a measurement method selected from or combining any of the following measurement methods to measure the film thickness of or the reflectance of the collector mirror 3-1, and the amount of debris or other contaminants adhering to or deposited on the collector mirror 3-1 is determined on the basis of the film thickness or reflectance thus measured (step 202).

a) Quartz crystal microbalance measurement method to measure the film thickness of the collector mirror 3;

b) Spectroscopic ellipsometry for measuring the film thickness of the collector mirror 3; and c) Measurement of the reflectance of the collector mirror 3.

Subsequently, it is determined whether or not the collector mirror 3-1 requires cleaning, for example by comparing the amount of the contaminants adhering to or deposited on the collector mirror 3-1 obtained by the measurement with a predetermined threshold value. This determination is performed by the cleaning necessity determination portion 52 in the controller 50 (step 203).

If it is determined that the collector mirror 3-1 requires cleaning (determined YES in step 203), a collector mirror conveyance command is output so that the collector mirror 3 located at the EUV light condensing position M (the collector mirror 3-1) is conveyed to the cleaning position C in the cleaning chamber 20 (the cleaning position C1 in the cleaning chamber 21), and the collector mirror 3 currently located at the cleaning position C in the cleaning chamber 20 (the collector mirror 3-2 located at the cleaning position C2 in the cleaning chamber 22) is conveyed to the EUV light condensing position M (see time τ2 in FIG. 5) (step 203).

On the other hand, the collector mirror 3-2 is located at the cleaning position C2 in the cleaning chamber 2 and is being cleaned to remove the debris and other contaminants attached to and deposited on the collector mirror 3-2.

The gate valve GV2 of the cleaning chamber 22 is closed while the collector mirror 3-2 is being cleaned and the EUV light is being generated. This blocks the communication between the cleaning chamber 22 and the vacuum chamber 2, whereby the atmosphere in the cleaning chamber 22 is isolated from the atmosphere in the EUV chamber 2 during cleaning of the collector mirror 3-2 and generation of the EUV light. Accordingly, the cleaning of the collector mirror 3-2 and the generation of the EUV light can be performed in a desirable manner.

It is desirable that the cleaning process in the cleaning chamber 22 is promptly completed before the collector mirror conveyance command is output (before time τ2 in FIG. 5).

Therefore, it is desirable to use the above-described reaction acceleration means to accelerate the reaction between the reactive gas G and the contaminants to reduce the cleaning time (step 301).

Subsequently, a measurement is conducted on the collector mirror 3-2 to determine whether or not the cleaning of the collector mirror 3-2 has been completed. Specifically, the measurement is conducted by using a measurement method selected from or combining any of the following measurement methods to measure the film thickness or the reflectance of the collector mirror 3-2, and the degree of progress of cleaning of the collector mirror 3-2 is determined on the basis of the measurement value of the film thickness or reflectance.

a) Quartz crystal microbalance measurement method to measure the film thickness of the collector mirror 3;

b) Spectroscopic ellipsometry to measure the film thickness of the collector mirror 3;

c) Measurement of the reflectance of the collector mirror 3;

d) Measurement of the concentrations of the contaminants and the reactive gas G; and e) Measurement of the period of time required for the cleaning.

The measurement of the progress of the cleaning process can be performed either by using the above-mentioned device for measuring the amount of contaminants, or by using a FTIR gas analyzer or plasma emission spectrometry end point monitor for use in manufacture of semiconductor etching devices or the like (step 302).

Subsequently, it is determined whether or not the cleaning of the collector mirror 3-2 has been completed for example by comparing the progress of the cleaning process of the collector mirror 3-2 with a predetermined threshold value. This determination is performed by the cleaning termination determination portion 51 of the controller 50 (step 303).

If it is determined that the cleaning of the collector mirror 3-2 has not been completed (determined NO in step 303), it is then determined whether or not the collector mirror 3-2 has been deteriorated and has reached the end of its useful life. Specifically, the film thickness, the reflectance or the like of the collector mirror 3-2 is measured by using any one of the above-mentioned methods (a) to (d) or combining any of them, and whether or not the collector mirror 3-2 has reached the end of its useful life is determined on the basis of the measurement value of the film thickness, the reflectance or the like. The measurement value of the film thickness, the reflectance or the like of the collector mirror 3-2 thus obtained is compared with a predetermined threshold value to determine whether or not the collector mirror 3-2 has reached the end of its useful life. This determination is performed by the useful life determination portion 53 of the controller 50 (step 304).

If it is determined that the collector mirror 3-2 has reached the end of its useful life (determined YES in step 304), the cleaning chamber 22 is purged with an inert gas to prevent the atmospheric air from entering the cleaning chamber 22 when replacing the existing collector mirror 3-2 with a new one (step 305). The collector mirror 3-2 is replaced with a new one in the cleaning chamber 22 (step 306). The entrance of the atmospheric air into the cleaning chamber 22 is prevented during the replacement of the collector mirror 3-2 with a new one, for the purpose of preventing contamination or corrosion of the cleaning chamber 22 possibly caused by the entrance of the atmospheric air into the cleaning chamber 22.

After the replacement of the collector mirror, the cleaning chamber 22 is further purged. Specifically, the atmosphere in the cleaning chamber 22 is replaced several times with an inert gas such as Ar or $N_2$ gas in order to prepare for conveyance of the collector mirror 3-2. After that, the gas is discharged from the cleaning chamber 22 until the pressure within the cleaning chamber 22 becomes equivalent to the pressure within the vacuum chamber (step 307).

If it is determined that the collector mirror 3-2 has not reached the end of its useful life (determined NO in step 304), the processing returns to step 301 to perform the cleaning process.

If it is determined in step 303 that the cleaning has been completed (determined YES in step 303), or when the purge of the chamber after the replacement of the collector mirror has been completed (step 307), the processing proceeds to the next step 308.

The cleaning or replacement of the collector mirror 3-2 described above is rapidly performed earlier than time $\tau 2$ at which a collector mirror conveyance command is output (at time $\tau 1$ ($<\tau 2$) in FIG. 5).

Subsequently, it is determined whether or not a collector mirror conveyance command has been output (step 308).

If it is determined that a collector mirror conveyance command has been output (determined YES in step 308), the gate valves GV1 and GV2 of the cleaning chambers 21 and 22 are opened to convey the collector mirrors 3-1 and 3-2. The opening and closing of the gate valves GV1 and GV2 are controlled by the conveyance control portion 54 of the controller 50 (step 309).

The conveyance control portion 54 of the controller 50 then controls the transfer rod 31 to convey the collector mirror 3-1 located at the EUV light condensing position M and requiring cleaning to the cleaning position C1 in the cleaning chamber 21. In addition, the conveyance control portion 54 of the controller 50 controls the transfer rod 32 to convey the collector mirror 3-2 located at the cleaning position C2 in the cleaning chamber 22 and having been cleaned to the EUV light condensing position M. The conveyance of the collector mirror 3-1 is performed simultaneously with the conveyance of the collector mirror 3-2, whereby the processing time can be reduced (see time $\tau 2$ to $\tau 3$ in FIG. 5).

As described above, once it is determined that the cleaning of the collector mirror 3-2 has been completed in the cleaning chamber 22 and it is also determined that the collector mirror 3-1 located at the EUV light condensing position M requires cleaning, the collector mirror 3-1 located at the EUV light condensing position M and requiring cleaning is conveyed to the cleaning chamber 21, while the collector mirror 3-2 located in the cleaning chamber 22 and having been cleaned is conveyed to the EUV light condensing position M.

In the case where the existing collector mirror 3-2 is replaced with a new one in step 306, once the replacement of the collector mirror 3-2 has been completed and it is determined that the collector mirror 3-1 located at the EUV light condensing position M requires cleaning, the conveyance control portion 54 of the controller 50 controls the transfer rod 31 to convey the collector mirror 3-1 located at the EUV light condensing position M and requiring cleaning to the cleaning position C1 in the cleaning chamber 21. The conveyance control portion 54 of the controller 50 also controls the transfer rod 32 to convey the collector mirror 3-2 having been replaced to the EUV light condensing position M. The conveyance of the collector mirror 3-1 and the conveyance of the collector mirror 3-2 are performed simultaneously whereby the time reduction is achieved (see time $\tau 2$ to time $\tau 3$ in FIG. 5) (step 310).

Once the collector mirror 3-1 has been conveyed into cleaning chamber 21 and the collector mirror 3-2 has been conveyed out of the cleaning chamber 22, the gate valves GV1 and GV2 of the cleaning chambers 21 and 22 are closed so that the collector mirror 3-1 is cleaned in the cleaning chamber 21 and the EUV light is collected by the collector mirror 3-2 (step 311).

Once the collector mirror 3-2 has been located at the EUV light condensing position M, the collector mirror 3-2 is placed on the mirror alignment stage 8 by the positioning mechanism 60 with a high positioning accuracy. The optical axis of the collector mirror 3-2 is then adjusted on the mirror alignment stage 8 (step 205). After the adjustment of the optical axis of the collector mirror 3-2 is completed, emission of the EUV light is started and exposure is commenced (step 201). After that, the same processing as described above is performed with the collector mirror 3-1 and the collector mirror 3-2 being replaced with each other, and the cleaning chamber 21 (the cleaning position C1) and the cleaning chamber 22 (the cleaning position C2) being replaced with each other (time $\tau 3$ to $\tau 4$ to $\tau 5$ in FIG. 5).

According to this embodiment as described above, once it is determined that the cleaning of the collector mirror 3-2 located at the cleaning position C2 has been completed and that the collector mirror 3-1 located at the EUV light condensing position M requires cleaning, the collector mirror 3-1 located at the EUV light condensing position M and requiring cleaning is conveyed to the cleaning position C1 while the collector mirror 3-2 located at the cleaning position C2 and of which cleaning has been completed is conveyed to the EUV light condensing position M. This makes it possible to use the collector mirror 3-1 to collect the EUV light while the other collector mirror 3-2 is being cleaned. When the collector mirror 3-1 which has been used for collecting the EUV light needs to be cleaned, the collector mirror 3-1 can be cleaned promptly, and the other collector mirror 3-2 which has been cleaned can be used promptly for collecting the EUV light. This makes it possible to reduce the downtime of the EUV light generator caused by cleaning of the collector mirror 3.

Further, when it is determined that the collector mirror 3-2 located at the cleaning position C2 has reached the end of its useful life, this collector mirror 3-2 is replaced with a new one. Once the collector mirror 3-2 has replaced with a new one and it is determined that the collector mirror 3-1 located at the EUV light condensing position M requires cleaning, the collector mirror 3-1 located at the EUV light condensing position M and requiring cleaning is conveyed to the cleaning position C1 while the collector mirror 3-2 which has been replaced with the old one is conveyed to the EUV light condensing position M. This makes it possible to use the collector mirror 3-1 to generate EUV light while the other collector mirror 3-2 is being replaced. Further, the collector mirror 3-1 can be cleaned promptly when the collector mirror 3-1 which has been used to collect the EUV light needs to be cleaned, while the other collector mirror 3-2, which has been replaced with the old one, can be promptly used for collecting the EUV light. This makes it possible to reduce the downtime of the EUV light generator caused by replacement of the collector mirror 3.

Figure 6:
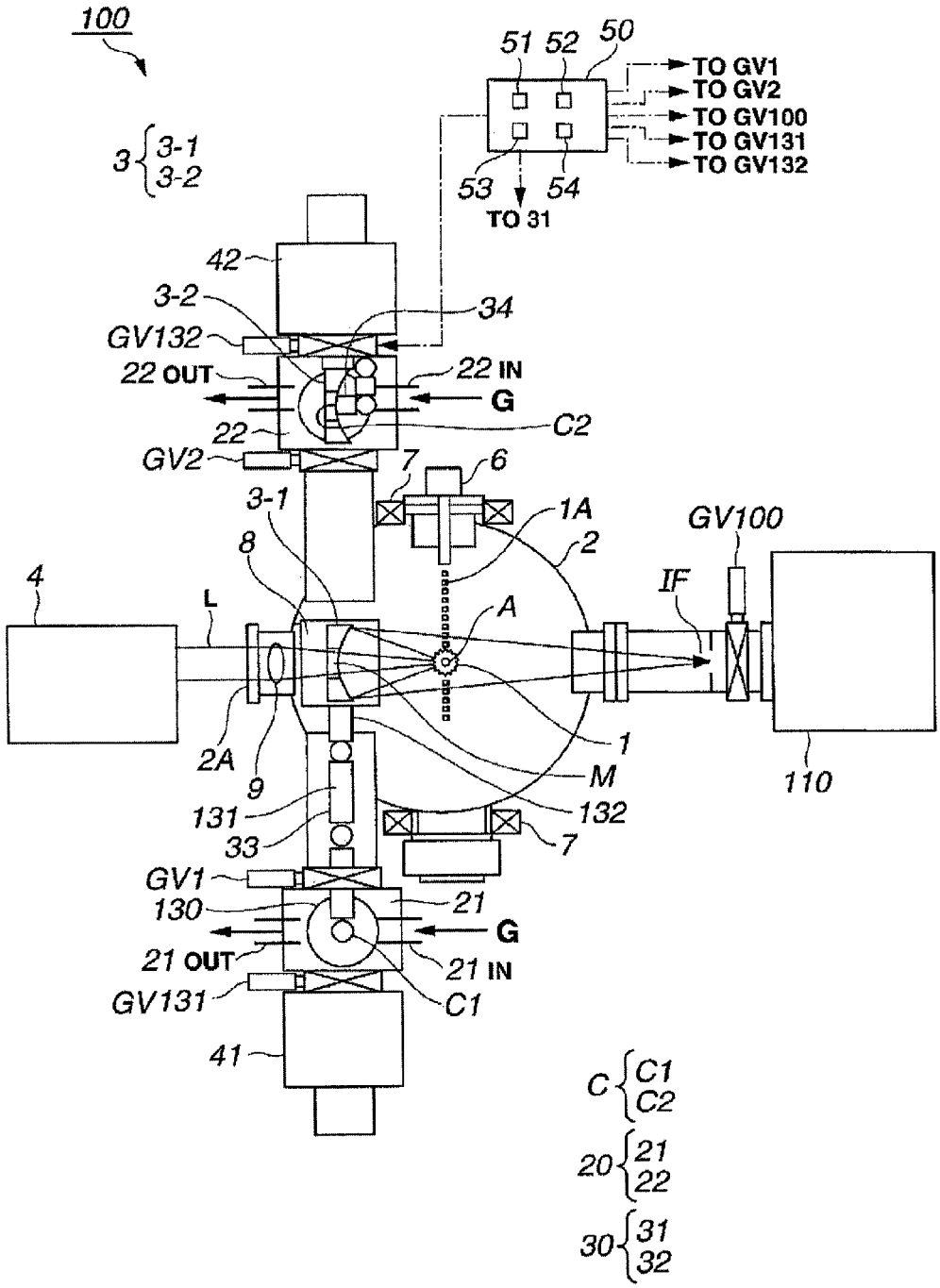
FIG. 6 is a diagram showing a configuration of an apparatus according to an embodiment of the invention in which a conveyor robot is used as conveyance means.

FIG. 6 shows a configuration example of an apparatus according to another embodiment of the invention, in which conveyor robots 33 and 34 are provided as the conveyance means in place of the transfer rods 31 and 32 shown in FIG. 2.

The conveyor robot 33 has a turnable base 130, and an articulated arm 131 provided retractably on the base 130. A hand 132 is provided at the distal end of the arm 131 so as to place the collector mirror 3-1 thereon and to support the collector mirror 3-1 from below Instead of the above-described structure, the hand 132 may have any given structure such as being able to grip or attract the collector mirror 3-1.

Like the conveyor robot 33, the conveyor robot 34 is also formed so as to be able to convey the collector mirror 3-2.

The cleaning chambers 21 and 22 communicate with load lock chambers 41 and 42, respectively. A closable gate valve GV131 is provided between the cleaning chamber 21 and the load lock chamber 41, while a closable gate valve GV132 is provided between the cleaning chamber 22 and the load lock chamber 42.

The load lock chambers 41 and 42 are open to the atmospheric air. The collector mirrors 3-1 and 3-2 are replaced with new collector mirrors in the load lock chambers 41 and 42, respectively.

It is assumed here that it is determined that the collector mirror 3-1 needs to be cleaned and cleaning of the collector mirror 3-2 has been completed in the state in which, as shown in FIG. 6, the collector mirror 3-1 is located at the EUV light condensing position M in the vacuum chamber 2, while the collector mirror 3-2 is located at the cleaning position C2 in the cleaning chamber 22.

The conveyance control portion 54 of the controller 50 then controls the conveyor robot 33 to convey the collector mirror 3-1 located at the EUV light condensing position M and requiring cleaning to the cleaning position C1 in the cleaning chamber 21. During this conveyance, the hand 131 of the conveyor robot 33 is retracted to above the base 130 to move the collector mirror 3-1 from the EUV light condensing position M to the cleaning position C1 in the cleaning chamber 21. The conveyance control portion 54 of the controller 50 controls the conveyor robot 34 to convey the collector mirror 3-2 located at the cleaning position C2 in the cleaning chamber 22 and having been cleaned to the EUV light condensing position M. During this conveyance, the hand 131 of the conveyor robot 34 is extended from the state where the hand 131 is retracted above the base 130, to move the collector mirror 3-2 from the cleaning position C2 in the cleaning chamber 22 to the EUV light condensing position M.

When the collector mirror 3-2 has reached the end of its useful life and needs to be replaced with a new one, the conveyance control portion 54 of the controller 50 opens the gate valve GV132 to allow communication between the cleaning chamber 22 and the load lock chamber 42. The conveyance control portion 54 of the controller 50 then controls the conveyor robot 34 to convey the collector mirror 3-2 located at the cleaning position C2 in the cleaning chamber 22 into the load lock chamber 42. During this conveyance, the hand 131 of the conveyor robot 34 is extended from the state where the hand 131 is retracted above the base 130 toward the load lock chamber 42 in an opposite direction relative to the EUV light condensing position M, and the collector mirror 3-2 is moved from the cleaning position C2 in the cleaning chamber 22 to the inside of the load lock chamber 42. The hand 131 of the conveyor robot 34 is then retracted to above the base 130 and separated from the collector mirror 3-2. Subsequently, the gate valve GV132 is closed to block the communication between the cleaning chamber 22 and the load lock chamber 42. Then, the collector mirror 3-2 is replaced with a new one in the load lock chamber 42. After the replacement of the collector mirror, the gate valve GV132 is reopened to allow communication between the cleaning chamber 22 and the load lock chamber 42. The conveyor robot 34 is controlled to convey the collector mirror 3-2 located in the load lock chamber 42 to the EUV light condensing position M. During this conveyance, the hand 131 of the conveyor robot 34 is extended toward the EUV light condensing position M in an opposite direction relative to the load lock chamber 42, whereby the collector mirror 3-2 is moved from the load lock chamber 42 to the EUV light condensing position M.

After that, the same processing as described above is performed with the collector mirror 3-1 being replaced with the collector mirror 3-2 and the cleaning chamber 21 (the cleaning position C1) being replaced with the cleaning chamber 22 (the cleaning position C2).

According to the embodiment shown in FIG. 6, the collector mirrors 3-1 and 3-2 are replaced with new ones in the load lock chambers 41 and 42 which are completely isolated from the cleaning chambers 21 and 22. This makes it possible to effectively prevent the entry of the atmospheric air into the cleaning chambers 21 and 22 during the replacement of the collector mirrors. This in turn makes it possible to effectively prevent the contamination or corrosion of the cleaning chambers 21 and 22 possibly caused by the entry of the atmospheric air into the cleaning chambers 21 and 22.

The above description of the embodiments has been made on the assumption that two collector mirrors 3 are provided and these collector mirrors 3-1 and 3-2 are individually provided with conveyor means. However, the present invention is also applicable to a case in which three or more collector mirrors 3 are provided. When three collector mirrors 3 are provided, for example, three units of conveyor means are provided in association with the respective three collector mirrors 3. In this case, a third conveyor means 30 may be added such that the third conveyor means 30 can convey the third collector mirror 3-3 in a perpendicular direction to the sheet surface of FIGS. 2 and 6.

Further, the above description of the embodiments has been made on the assumption that the conveyor means 30 and the cleaning chamber 20 are each provided in plurality. However, the conveyor means 30 and the cleaning chamber 20 may be each provided in singularity.

Figure 7:
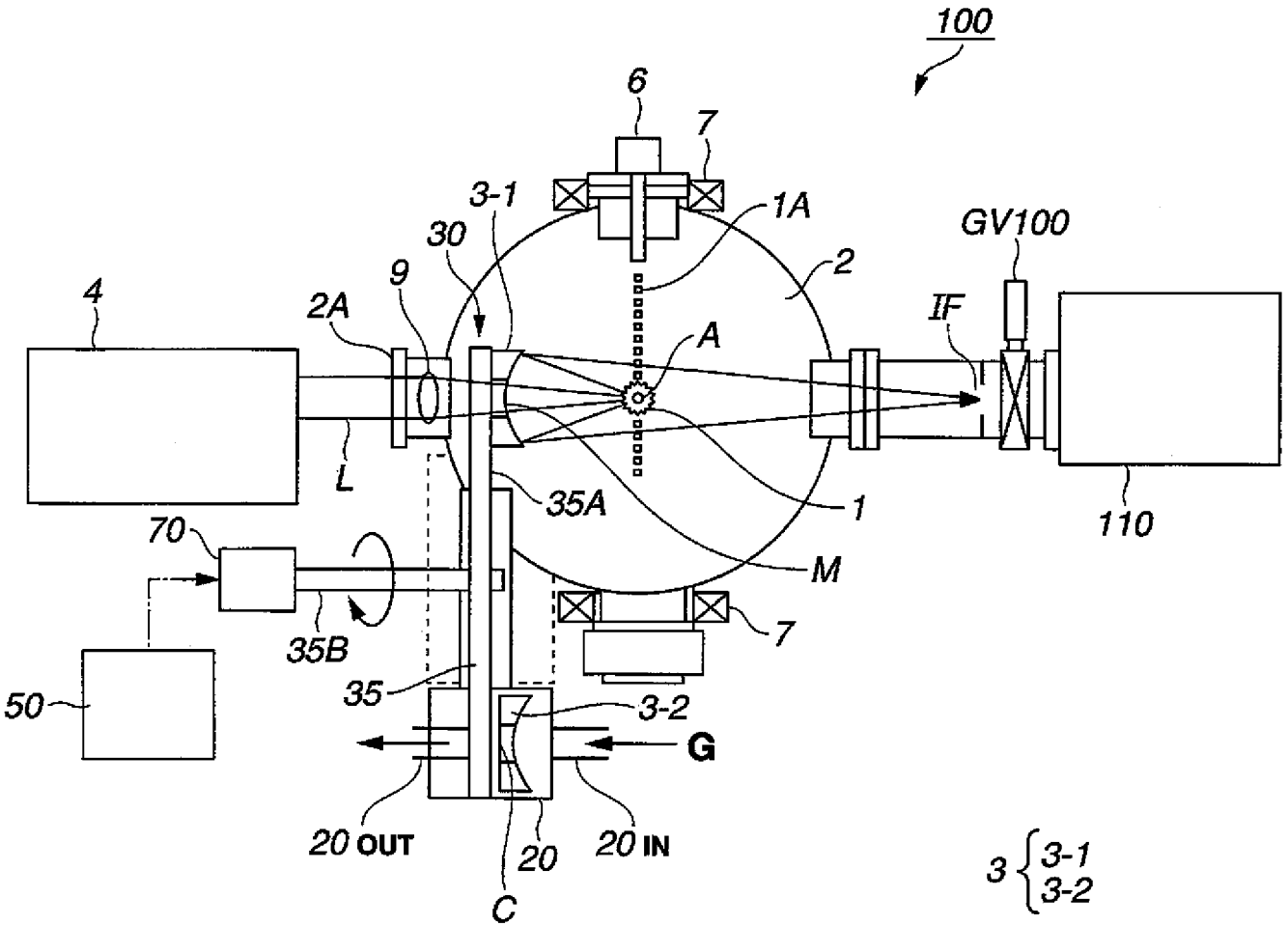
FIG. 7 is a diagram showing a configuration example of an apparatus according to an embodiment of the invention in which a single conveyance unit and a single cleaning chamber are provided.

In an apparatus shown in FIG. 7, conveyor means 30 includes a rotating body 35 having two collector mirrors 3-1 and 3-2 disposed on the same rotary surface 35A, and a rotating shaft 35B for rotating the rotating body 35. The rotation of the rotating shaft 35B is activated by an actuator 70. A control means 50 controls the actuator 70 to rotate the rotating shaft 35B so that the collector mirrors 3-1 and 3-2 located on the same rotary surface 35A are positioned in the cleaning chamber 20 and at the EUV light condensing position M, respectively. Thus, according to this embodiment, the apparatus can be formed with only one conveyor means 30 and only one cleaning chamber 20. The apparatus shown in FIG. 7 is also applicable to a case where three or more collector mirrors 3 are provided. When three collector mirrors 3 are to be provided in the apparatus of FIG. 7, for example, a third collector mirror 3-3 may be additionally provided on the rotary surface 35A of the rotating body 35.

Figure 8:
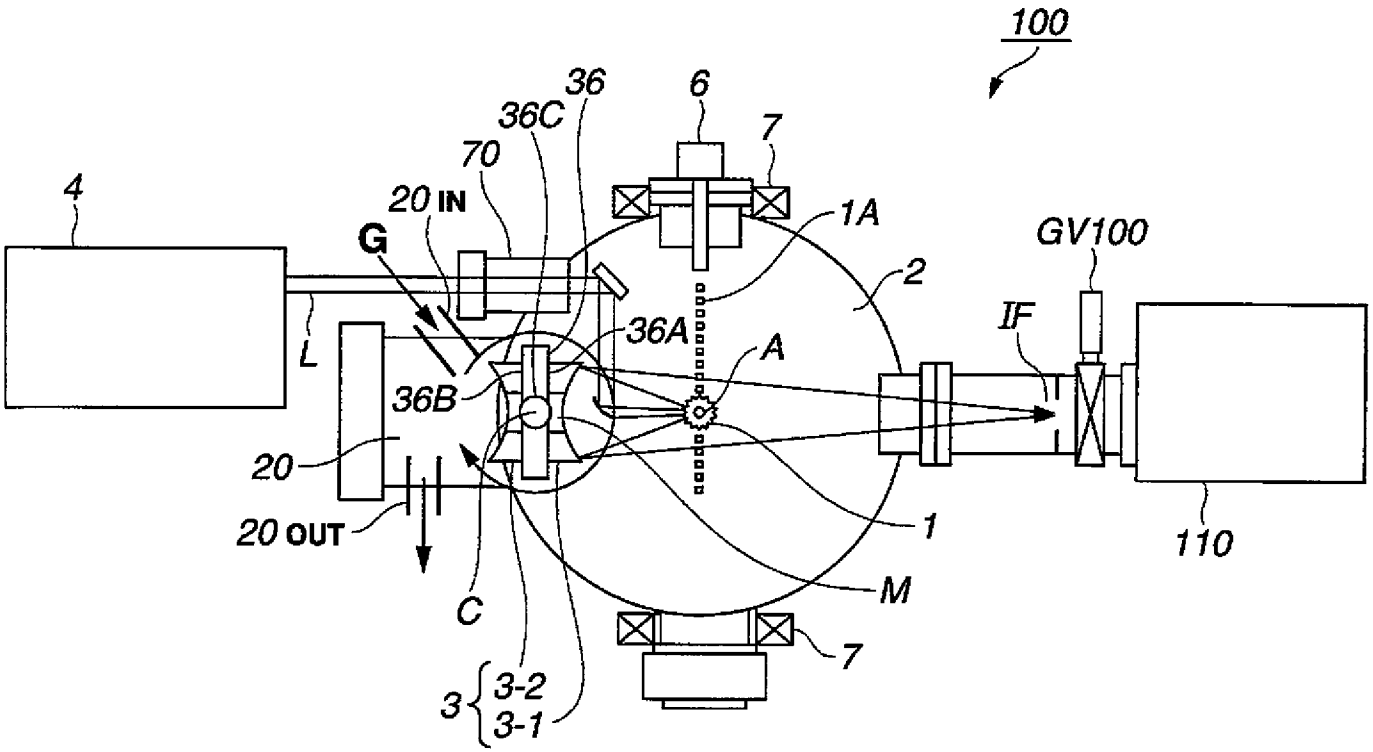
FIG. 8 is a diagram showing a configuration example of an apparatus according to a different embodiment from the one shown in FIG. 7 in which a single conveyance unit and a single cleaning chamber are provided.

In an apparatus shown in FIG. 8, a conveyor means 30 includes a rotating plate 36 having two collector mirrors 3-1 and 3-2 disposed on its front surface 36A and rear surface 36B, respectively, and a rotating shaft 36C for rotating the rotating plate 36 such that the front 36A and rear surfaces 36B of the rotating plate 36 rotate to reverse their positions each other. The rotation of the rotating shaft 36C is activated by an actuator 70. Control means 50 controls the actuator 70 to rotate the rotating shaft 36C, whereby the collector mirror 3-1 on the front surface 36A of the rotating plate 36 and the collector mirror 3-2 on the rear surface 36B are positioned in the cleaning chamber 20 and at the EUV light condensing position M, respectively. According to this embodiment, therefore, the apparatus can be formed with only one conveyor means 30 and with only one cleaning chamber 20.

The configurations of the conveyor means 30 according to the embodiments described above provide only illustrative example, and any other configuration may be employed for the conveyor means 30 as long as it can convey the collector mirror 3. For example, the conveyor means 30 may be formed by a movable stage so that the collector mirror 3 is placed on the movable stage and moved reciprocally between the EUV light condensing position M and the cleaning chamber 20.

Further, the conveyor means 30 may be formed by a wire so that the collector mirror 3 is moved reciprocally between the EUV light condensing position M and the cleaning chamber 20 by pulling the wire.

What is claimed is:

1. A cleaning apparatus for cleaning collector mirrors in an EUV light generator in which a target is made into a plasma state and EUV light generated is collected and output by a collector mirror, the apparatus being applied to the EUV light generator for cleaning debris adhering to the collector mirror, the apparatus comprising:

a first chamber within which plasma is generated, the collector mirrors which collect the EUV light radiated from the plasma, a second chamber arranged adjacent to the first chamber, a conveyor device which moves the collector mirror between the first chamber and the second chamber, a positioning mechanism which positions the collecting mirrors at an EUV light condensing position inside the first chamber, a gas supplying device which supplies a gas to the second chamber, a gas discharging device which discharges the gas out of the second chamber, a first gate valve provided between the first chamber and the second chamber, a second gate valve arranged at an EUV light outputting portion of the first chamber, and a controller connected to the first gate valve and the second gate valve, wherein:

the controller is configured to close the first gate valve and open the second gate valve at least while the EUV light is being generated.

2. The cleaning apparatus for cleaning collector mirrors in an EUV light generator as claimed in claim 1, wherein the gas supplying device is configured to supply any of Ar gas, $N_2$ gas and another inert gas to the inside of the second chamber.

3. The cleaning apparatus for cleaning collector mirrors in an EUV light generator as claimed in claim 1 further comprising a magnetic field line generator.

4. The cleaning apparatus for cleaning collector mirrors in an EUV light generator as claimed in claim 1 further comprising an FTIR gas analyzer or a plasma emission spectrometry end point monitor, wherein the controller is connected to the FTIR gas analyzer or the plasma emission spectrometry end point monitor.

5. The cleaning apparatus for cleaning collector mirrors in an EUV light generator as claimed in claim 1, wherein the conveyor device comprises a guide rail.

6. The cleaning apparatus for cleaning collector mirrors in an EUV light generator as claimed in claim 1, wherein:

at least two of second chambers and at least two of collector mirrors are respectively provided;

the conveyor device is provided in association with each of the at least two collector mirrors;

the controller is connected to each of the conveyor devices; and the controller activates the conveyor device associated with the collector mirror located at the EUV light condensing position to convey the collector mirror to the second chamber, and activates the conveyor device associated with the collector mirror positioned at the second chamber to convey the collector mirror to the EUV light condensing position.

7. The cleaning apparatus for cleaning collector mirrors in an EUV light generator as claimed in claim 6, wherein the conveyor device comprises a transfer rod for linearly moving the collector mirror reciprocally between the EUV light condensing position and the second chamber.

8. The cleaning apparatus for cleaning collector mirrors in an EUV light generator as claimed in claim 6, wherein the conveyor device comprises a movable stage for placing the collector mirror thereon and reciprocally moving the collector mirror between the EUV light condensing position and the second chamber.

9. The cleaning apparatus for cleaning collector mirrors in an EUV light generator as claimed in claim 6, wherein the conveyor device is configured to use a wire to move the collector mirror reciprocally between the EUV light condensing position and the second chamber.

10. The cleaning apparatus for cleaning collector mirrors in an EUV light generator as claimed in claim 1, wherein the gas supplying device is configured to supply, to the inside of the second chamber, a reactive gas which is reactive with debris adhering to the collector mirror.

11. The cleaning apparatus for cleaning collector mirrors in an EUV light generator as claimed in claim 10, wherein the reactive gas contains a gas selected from a group consisting of $H_2$, Ar, $N_2$, $F_2$, $Cl_2$, $Br_2$, $I_2$, HF, HCl, HBr, HI, and a mixture thereof.

12. The cleaning apparatus for cleaning collector mirrors in an EUV light generator as claimed in claim 10, further comprising reaction acceleration means for accelerating a reaction between the reactive gas and the debris adhering to the collector mirror.

13. The cleaning apparatus for cleaning collector mirrors in an EUV light generator as claimed in claim 12, wherein the reaction acceleration means is configured to accelerate the reaction between the reactive gas and the debris adhering to the collector mirror by one of heating one of the collector mirrors and the reactive gas, converting the reactive gas into plasma.

14. The cleaning apparatus for cleaning collector mirrors in a EUV light generator as claimed in claim 1, wherein the second chamber is configured to communicate with the atmospheric air by being differentially pumped by a differential pumping device.

15. The cleaning apparatus for cleaning collector mirrors in an EUV light generator as claimed in claim 1, wherein:

the conveyor device is connected to the controller, and the controller drives the conveyor device based on one or any measurement results of measuring the film thickness of the collector mirror with the use of a quartz crystal microbalance measurement method or a spectroscopic ellipsometry, measuring the reflectance of the collector mirror, or measuring the concentrations of the debris and the reactive gas.

* * * * *